US009476192B2

(12) United States Patent
Liu

(10) Patent No.: US 9,476,192 B2
(45) Date of Patent: Oct. 25, 2016

(54) SOFT-TOUCH DOUBLE-DRAIN VALVE

(75) Inventor: Yongmao Liu, Fujian (CN)

(73) Assignee: LAB (XIAMEN) SANITARY FITTINGS INC, Xiamen, Fujian (CN)

( * ) Notice: Subject to any disclaimer, the term of this patent is extended or adjusted under 35 U.S.C. 154(b) by 324 days.

(21) Appl. No.: 14/347,246

(22) PCT Filed: Dec. 22, 2011

(86) PCT No.: PCT/CN2011/084404

§ 371 (c)(1),
(2), (4) Date: Mar. 26, 2014

(87) PCT Pub. No.: WO2013/091206

PCT Pub. Date: Jun. 27, 2013

(65) Prior Publication Data

US 2014/0223656 A1 Aug. 14, 2014

(51) Int. Cl.
*E03D 1/34* (2006.01)
*E03D 1/14* (2006.01)

(52) U.S. Cl.
CPC ..... *E03D 1/34* (2013.01); *E03D 1/144* (2013.01)

(58) Field of Classification Search
CPC ..... E03D 1/34; E03D 1/142; E03D 1/144; E03D 5/02
USPC ..... 4/324–325, 378, 410, 415
See application file for complete search history.

(56) References Cited

U.S. PATENT DOCUMENTS 5,659,903 A * 8/1997 Hammarstedt ..... E03D 1/144 4/324
6,163,897 A * 12/2000 Plas ..... E03D 5/09 4/410
6,442,772 B2 * 9/2002 Han ..... E03D 1/142 4/325
8,104,104 B2 * 1/2012 Le ..... E03D 5/02 4/325
2008/0289091 A1 * 11/2008 Mahler ..... E03D 1/142 4/410

FOREIGN PATENT DOCUMENTS

CN 2454427 Y * 10/2001

OTHER PUBLICATIONS

CN 2454427 Y Machine Translation.*

* cited by examiner

*Primary Examiner* — Paul R Durand
*Assistant Examiner* — William R Klotz
(74) *Attorney, Agent, or Firm* — Leong C. Lei

(57) ABSTRACT

A soft-touch double-drain valve includes a full-drain float including a large water sealing plate covering a water discharging opening and a small water sealing plate mounted in an insertion hole. A main body includes an inner tube through hole and an adjustment hole formed therein. A partial-drain weight float includes a partial-drain adjustment press bar and an inner tube penetration hole. A first position-limiting mechanism is mounted in the main body. A second position-limiting mechanism is mounted to a full-drain push button or a partial-drain push button. An inner tube is inserted in the inner tube penetration hole, the through hole, and the insertion hole and is provided with a return spring and has a lower end operable in combination with the small water sealing plate and an upper end operable in combination with the full-drain and partial-drain push buttons to control downward movement.

4 Claims, 19 Drawing Sheets

SOFT-TOUCH DOUBLE-DRAIN VALVE

(a) TECHNICAL FIELD OF THE INVENTION

The present invention generally relates to a double-drain valve, and more particularly to a soft-touch double-drain valve.

(b) DESCRIPTION OF THE PRIOR ART

In modern technology, to save water, various double-drain valves have been developed in the industry and a large number of patents are also available. Detailed reviews of these patent documents reveal that the drain structures are almost lift types or rotary knob types. A large force is needed for operation and use, making the use inconvenient.

A soft-touch drain valve, which is a drain valve comprising an inner tube, can be operated by a minor depression force to accomplish flushing and thus possesses the advantages of easy operation and convenient use. However, heretofore, such as inner tube included drain valve can be available as having a full drain function and having no partial drain function. This will cause a waste of water resources in the use thereof, when what is needed is a small amount of draining water (partial drain) but what is actually done is a large amount of draining water (full drain).

Thus, the present invention aims to improve the structure of an inner tube included drain valve in order to achieve a soft-touch double-draining function. And, the present invention is made based on such an idea.

SUMMARY OF THE INVENTION

An object of the present invention is to provide a soft-touch double-drain valve, which has a simple structure for effectively achieving a double-draining function.

To achieve the above object, the present invention adopts the following solution:

A soft-touch double-drain valve comprises a full-drain push button, a partial-drain push button, a push button seat, a full-drain float, a partial-drain weight float, a main body, an inner tube, a first position-limiting mechanism, a second position-limiting mechanism, a small water sealing frame, a large water sealing plate, a small water sealing plate, and a base. The large water sealing plate is set on a water discharging opening of the base and the large water sealing plate is mounted at a bottom of the full-drain float. The full-drain float comprises an inner tube insertion hole formed therein and the small water sealing plate is mounted to the insertion hole. The main body is mounted on the base and the main body comprises an inner tube through hole and adjustment holes formed in a bottom thereof. The partial-drain weight float is mounted in the main body. The partial-drain weight float comprises a partial-drain adjustment press bar formed on a bottom thereof. The partial-drain adjustment press bar extends through the adjustment hole formed in the bottom of the main body and located above the full-drain float. The partial-drain weight float comprises an inner tube penetration hole formed therein. The first position-limiting mechanism is mounted in the main body. The push button seat is mounted atop the main body. The full-drain push button and the partial-drain push button are mounted to the push button seat. The second position-limiting mechanism is mounted to the full-drain push button or the partial-drain push button. The first position-limiting mechanism and the second position-limiting mechanism are operable with each other to prevent a downward movement of the partial-drain adjustment press bar in a full drain operation. The inner tube extends through the inner tube penetration hole, the inner tube through hole, and the inner tube insertion hole. The inner tube is provided with a return spring. The inner tube has a lower end to which a small water sealing frame that is operable in combination with the small water sealing plate is mounted. The inner tube has an upper end that is operable in combination with the full-drain push button and the partial-drain push button to control the downward movement of the inner tube.

The partial-drain weight float further comprises a partial-drain rack. The partial-drain weight float is mounted to the partial-drain rack in an up-down adjustable manner. The partial-drain rack is provided, at the bottom thereof, with the partial-drain adjustment press bar. The partial-drain weight float has a lower portion forming a float and an upper portion forming a water storage cup.

The partial-drain weight float comprises a weigh portion that comprises a water storage cup that is formed separately. The partial-drain weight float comprises a float portion that is formed on the partial-drain rack.

A position-limiting insertion slot is formed in the partial-drain weight float or the partial-drain rack. The position-limiting insertion slot constitutes the first position-limiting mechanism. A triangular block is mounted under the full-drain push button and the partial-drain push button. The full-drain push button and the partial-drain push button have bottoms that respectively form slope surfaces respectively corresponding to two slope side edges of the triangular block. The triangular block has a bottom side that forms a position-limiting block engageable with the position-limiting insertion slot. The triangular block and slope surfaces of the full-drain push button and the partial-drain push button collectively constitute the second position-limiting mechanism. When the triangular block is pressed downward with the full-drain push button, the position-limiting block of the triangular block is inserted into the position-limiting insertion slot thereby constraining descent of the partial-drain weight float and preventing a downward movement of the partial-drain adjustment press bar so as to achieve full drain and when the triangular block is pressed downward with the partial-drain push button, the position-limiting block of the triangular block is withdrawn out of the position-limiting insertion slot, releasing the constraint against the downward movement of the partial-drain adjustment press bar so as to allow for the achievement of partial drain.

The inner tube through hole of the main body further comprises a rotation ring mounted therein and a rotation angle limiting structure is arranged between the main body and the rotation ring. The rotation ring is fit over the inner tube. The rotation ring comprises a locking guide surface and an unlocking guide surface. The rotation ring further comprises a first descent-limiting block. A second descent-limiting block is formed on the partial-drain weight float or the partial-drain rack. The inner tube comprises a locking pressing block formed on an outside wall thereof to correspond to the locking guide surface. The above structures constitute the first position-limiting mechanism. The partial-drain push button comprises an unlocking pressing block formed on a lower end thereof to correspond to the unlocking guide surface and the unlocking pressing block constitutes the second position-limiting mechanism. The full-drain push button is operable to depress the inner tube to move the locking pressing block of the inner tube into engagement with the locking guide surface so as to cause the rotation ring to rotate to a position where the first descent-limiting block is in alignment with the second descent-limiting block to thereby constrain descent of the partial-drain weight float and prevent a downward movement of the partial-drain adjustment press bar so as to achieve full drain and the partial-drain push button is operable to move the unlocking pressing block into engagement with the unlocking guide surface to cause the rotation ring to rotate to a position where the first descent-limiting block is shifted away from the second descent-limiting block, releasing the constraint against the downward movement of the partial-drain adjustment press bar thereby achieving partial drain.

The rotation angle limiting structure is arranged in such a way that a slot is formed in a top edge of the inner tube through hole of the main body and a raised strip is formed on an outer wall of the rotation ring and is slidable and thus rotatable in the slot, whereby a combination of the slot and the raised strip achieve constraint of rotation angle of the rotation ring with respect to the main body.

The raised strip and the first descent-limiting block of the rotation ring are integrated together so that a top end of the raised strip serves as the first descent-limiting block.

An axially extending recessed slot and an axially extending rib are respectively formed in an inside wall of the inner tube through hole and on an outside wall of the inner tube. The rib is engageable with the recessed slot to prevent rotation of the inner tube in the through hole, so as to ensure the unlocking pressing block of the inner tube and the unlocking guide surface of the rotation ring can be set in accurate alignment with each other.

The partial-drain weight float comprises a resilient pawl and hook strips formed on a side wall thereof. The resilient pawl has an upper end connected to the partial-drain weight float and a lower end forming a positioning block extending inward and a wedge-like inclined pull block extending outwards. The partial-drain rack comprises an up-down adjustment bar formed on a side wall thereof. The up-down adjustment bar comprises a row of adjustment teeth formed thereon for engagement with the positioning block of the partial-drain weight float. The main body has a side surface in which an adjustment window is formed. The partial-drain adjustment plate is mounted in the adjustment window and the partial-drain adjustment plate is in the form of a frame having two lateral sides forming retention strips engageable with the hook strips to mount the partial-drain adjustment plate to the partial-drain weight float and top and bottom sides forming operation blocks extending outward. The top and bottom sides further form inclined push blocks extending into the frame to mate the inclined pull block.

A positioning hook is formed in the partial-drain weight and positioning teeth are formed on the opposite side of the adjustment teeth of the partial-drain float rack, whereby the partial-drain weight is positioned on the partial-drain float rack by means of engagement between the positioning hook and the positioning teeth.

By adopting the above structure, the present invention is made simple in structure, wherein a partial-drain push button, a partial-drain weight float, and a first position-limiting mechanism and a second position-limiting mechanism are arranged on an inner tube included double-drain valve. In use, full drain and partial drain are carried out as follows:

When the full-drain push button is pressed down to cause the inner tube to move downward, the small water sealing frame mounted at the lower end of the inner tube is separated from the small water sealing plate mounted to the full-drain float, so that water is allowed to flow through the gap between the inner tube and the inner tube insertion hole of the full-drain float toward the water discharging opening of the base, whereby a negative pressure is instantaneously formed above the full-drain float, causing the full-drain float to automatically float upward to drive the large water sealing plate to move upwards therewith so as to open the water discharging opening of the base to achieve draining of water. Under this condition, the first position-limiting mechanism and the second position-limiting mechanism are operable in combination with each other to prevent downward movement of the partial-drain weight float, so that when the water level inside the water tank is lowered to a location where the buoyance of the full-drain float is less than the own weight of the full-drain float, the full-drain float is allowed to drive the large water sealing plate to cover back the water discharging opening of the base. When the full-drain push button is released, the inner tube is acted upon by the return spring to return to the original condition and the inner tube drives the small water sealing frame back to the original condition to re-engage the small water sealing plate of the full-drain float for closure. This realizes a full drain operation.

When the partial-drain push button is pressed down to cause the inner tube to move downward, the small water sealing frame arranged at the lower end of the inner tube is similarly separated from the small water sealing plate mounted to the full-drain float, so that water is allowed to flow through the gap between the inner tube and the inner tube insertion hole of the full-drain float toward the water discharging opening of the base, whereby a negative pressure is instantaneously formed above the full-drain float, causing the full-drain float to automatically float upward to cause the large water sealing plate to open the water discharging opening of the base to achieve draining of water. However, under this condition, the partial-drain weight float is not constrained by the first position-limiting mechanism and the second position-limiting mechanism and moves downward. When the water level inside the water tank drops to a predetermined water level line, water stored in the upper portion of the partial-drain weight float is converted to a gravitational force that is greater than the combination of the buoyance of the full-drain float and the buoyance generated by the lower portion of the partial-drain weight float and the partial-drain adjustment press bar drives the full-drain float to cause the large water sealing plate mounted to the full-drain float to early cover and close the water discharging opening of the base. When the partial-drain push button is released, the inner tube is acted upon by the return spring to return to the original condition and the inner tube drives the small water sealing frame back to the original condition to re-engage the small water sealing plate of the full-drain float for closure, thereby realizing a partial drain operation.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF THE DRAWINGS

FIG. 2-1 is a top-side exploded view, in a sectioned form, of the first embodiment of the present invention.

FIG. 3-1 is a cross-sectional view, taken from another angle, showing the initial condition of the first embodiment of the present invention (right side view of double-drain valve).

FIG. 4-1 is a cross-sectional view, taken from another angle, illustrating the full drain operation of the first embodiment of the present invention (right side view of double-drain valve).

FIG. 6-1 is a cross-sectional view, taken from another angle, illustrating the partial drain operation of the first embodiment of the present invention (right side view of double-drain valve).

FIG. 7-1 is a schematic view showing spatial relationship between a partial-drain weight and a partial-drain float rack of the present invention.

DETAILED DESCRIPTION OF THE PREFERRED EMBODIMENTS

Figure 1:
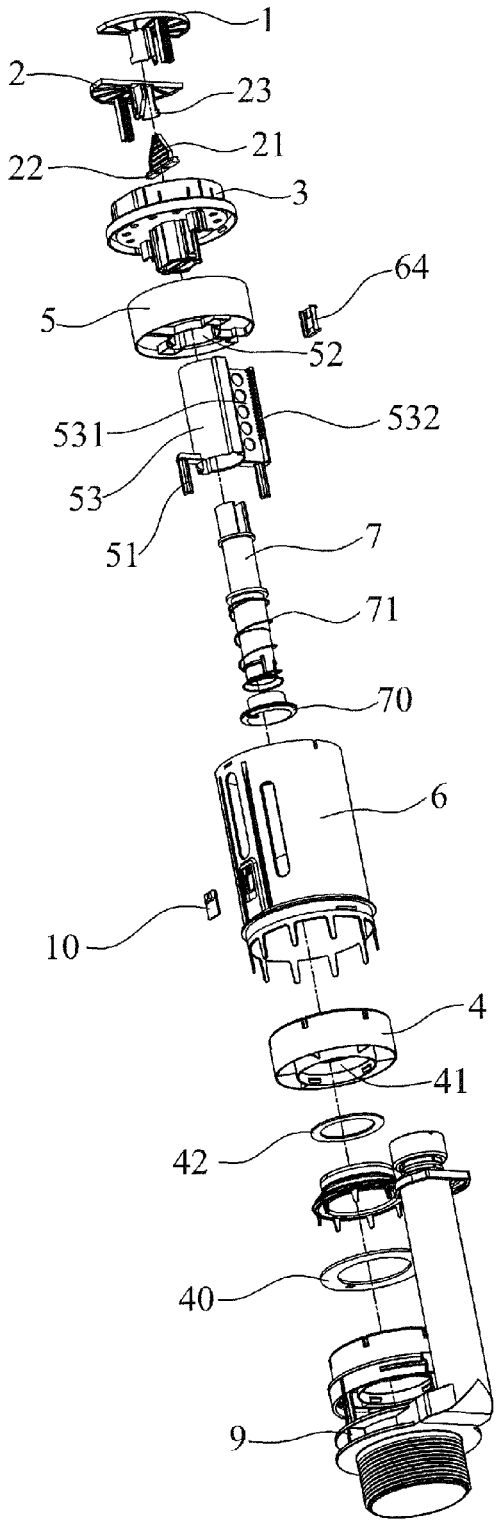
FIG. 1 is a bottom-side exploded view of a first embodiment of the present invention.
Figure 2:
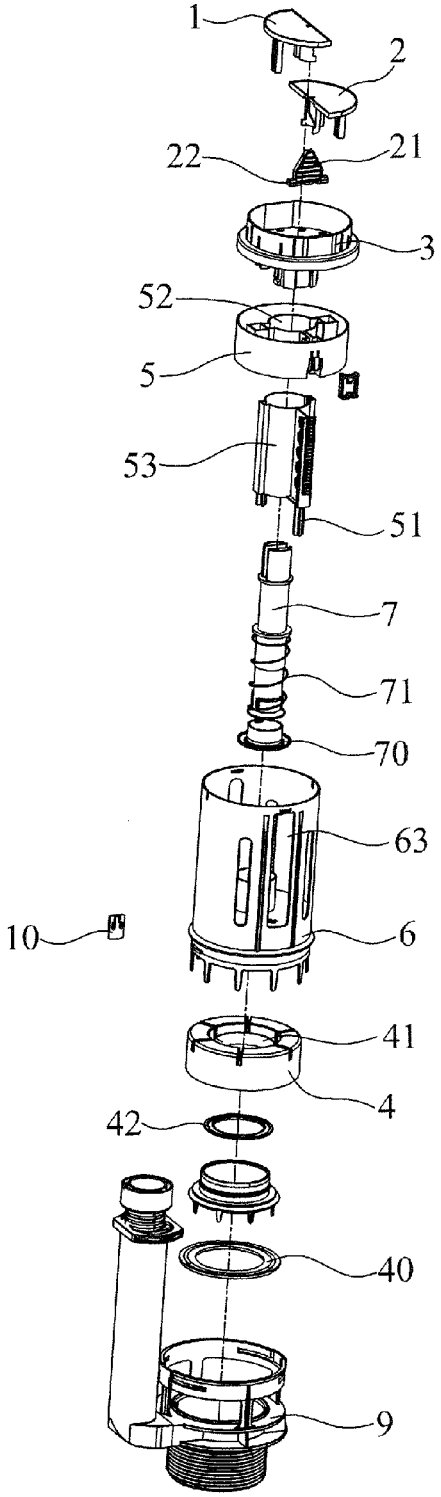
FIG. 2 is a top-side exploded view of the first embodiment of the present invention.
Figures 1, 2:
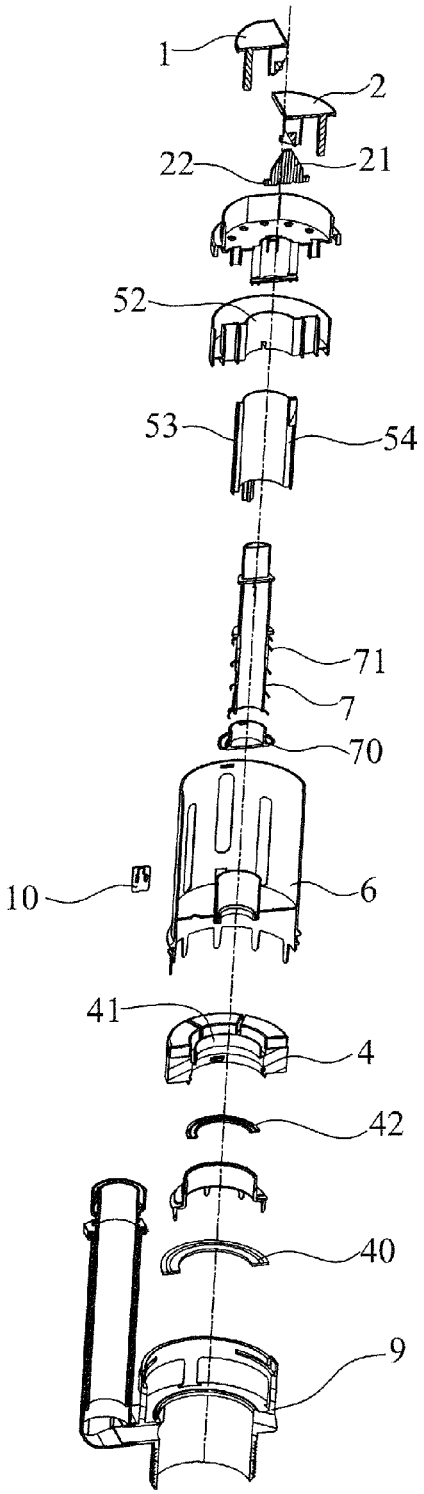

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-7, a soft-touch double-drain valve according to a first embodiment of the present invention is shown, comprising a full-drain push button 1, a partial-drain push button 2, a push button seat 3, a full-drain float 4, a partial-drain weight float 5, a main body 6, an inner tube 7, a first position-limiting mechanism, a second position-limiting mechanism, a small water sealing frame 70, a large water sealing plate 40, a small water sealing plate 42, and a base 9.

The large water sealing plate 40 is set on a water discharging opening of the base 9. The large water sealing plate 40 is mounted at a bottom of the full-drain float 4.

The full-drain float 4 comprises an inner tube insertion hole 41 formed therein and the small water sealing plate 42 is mounted to the insertion hole 41.

The main body 6 is mounted on the base 9. The mounting can be achieved by means of snap-fitting members or the likes. The main body 6 comprises an inner tube through hole 61 and adjustment holes 62 formed in a bottom thereof.

The partial-drain weight float 5 is mounted in the main body 6. The partial-drain weight float 5 comprises a float arranged at a lower portion thereof and a water storage cup arranged at an upper portion thereof. The partial-drain weight float 5 comprises a partial-drain adjustment press bar 51 formed on a bottom thereof. The partial-drain adjustment press bar 51 extends through the adjustment hole 62 formed in the bottom of the main body 6 and located above the full-drain float 4. The partial-drain weight float 5 comprises an inner tube penetration hole 52 formed therein. To achieve easy adjustment of the amount of water or partial drain, the partial-drain weight float 5 of the present invention further comprises a partial-drain rack 53. The partial-drain weight float 5 is mounted to the partial-drain rack 53 in an up-down adjustable manner. The partial-drain rack 53 is provided, at the bottom thereof, with the partial-drain adjustment press bar 51. A specific way of up-down adjustment will be described hereafter. It is also certainly possible to separately manufacture the weight part of the partial-drain weight float 5, which is constituted by the water storage cup, while the float part of the partial-drain weight float 5 is formed on the partial-drain rack 53, where the same effect can be achieved.

The first position-limiting mechanism is mounted in the main body 6. In the first embodiment, the first position-limiting mechanism specifically comprises a position-limiting insertion slot 54 formed in the partial-drain rack 53. For a partial-drain weight float that has no partial-drain rack, the position-limiting insertion slot can be instead formed in the partial-drain weight float.

The push button seat 3 is mounted atop the main body 6.

The full-drain push button 1 and the partial-drain push button 2 are mounted to the push button seat 3.

The second position-limiting mechanism is mounted in the full-drain push button 1 or the partial-drain push button 2 and in the first embodiment, is a triangular block 21 mounted under the full-drain push button 1 and the partial-drain push button 2. The full-drain push button 1 and the partial-drain push button 2 have bottoms that respectively form a slope surface 11 and a slope surface 23 respectively corresponding to two slope side edges of the triangular block 21. The triangular block 21 has a bottom side that forms a position-limiting block 22 engageable with the position-limiting insertion slot 54. The triangular block 21 and slope surfaces of the full-drain push button 1 and the partial-drain push button 2 collectively constitute the second position-limiting mechanism. The first position-limiting mechanism and the second position-limiting mechanism are operable with each other to prevent a downward movement of the partial-drain adjustment press bar 51 in a full drain operation. A specific operation will be illustrated with reference to FIGS. 3-6. When the triangular block 21 is pressed downward with the full-drain push button 1, the position-limiting block 22 of the triangular block 21 is inserted into the position-limiting insertion slot 54 thereby constraining descent of the partial-drain weight float 5 and preventing a downward movement of the partial-drain adjustment press bar 51 so as to achieve full drain. When the triangular block 21 is pressed downward with the partial-drain push button 2, the position-limiting block 22 of the triangular block 21 is withdrawn out of the position-limiting insertion slot 54, releasing the constraint against the downward movement of the partial-drain adjustment press bar 51 so as to allow for the achievement of partial drain.

The inner tube 7 extends through the inner tube penetration hole 52, the inner tube through hole 61, and the inner tube insertion hole 41. The inner tube 7 is provided with a return spring 71. The return spring 71 returns to the inner tube 7 to the original position after each drain. The inner tube 7 has a lower end to which a small water sealing frame 70 that is operable in combination with the small water sealing plate 42 is mounted. The inner tube 7 has an upper end that is operable in combination with the full-drain push button 1 and the partial-drain push button 2 to control the downward movement of the inner tube 7 so as to accomplish full drain and partial drain.

Figures 1, 3:
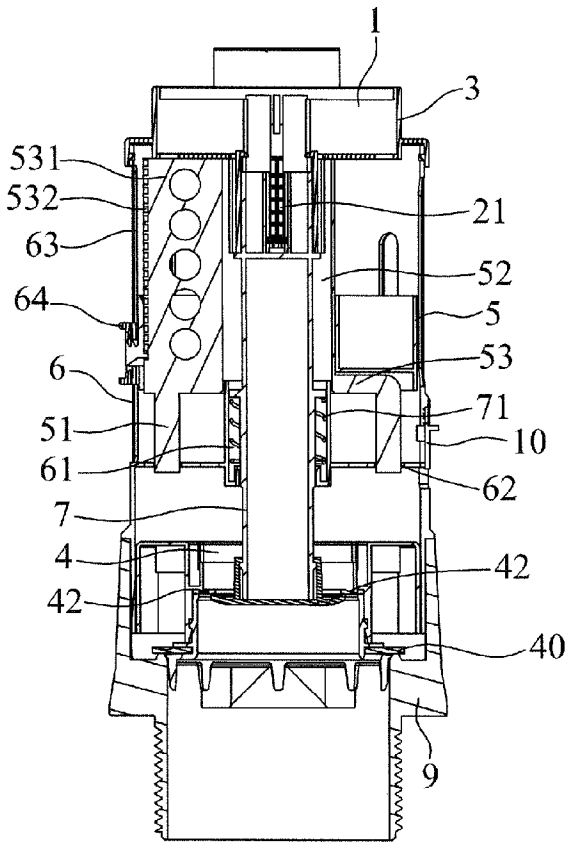
FIG. 3 is a cross-sectional view showing an initial condition of the first embodiment of the present invention (front view of double-drain valve).
Figure 3:
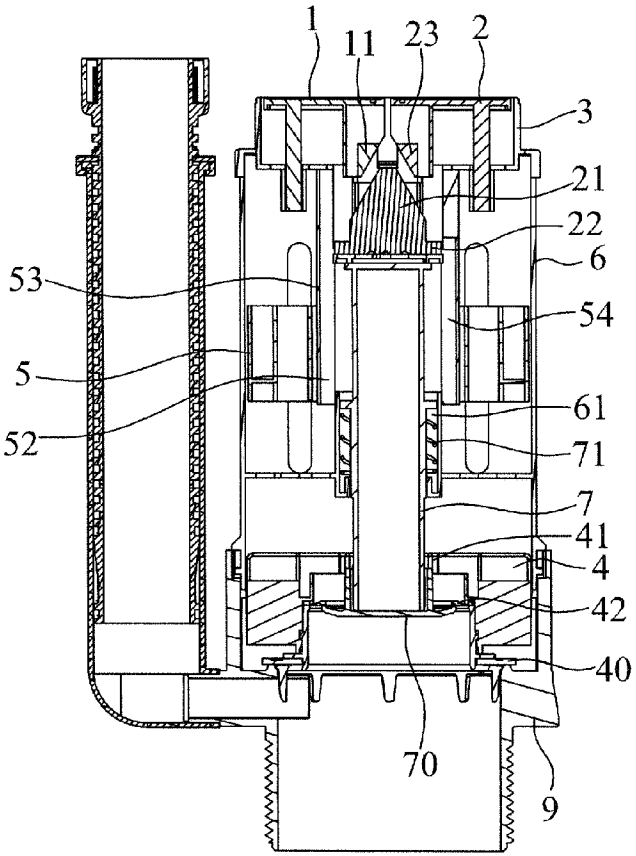
Figures 1, 4:
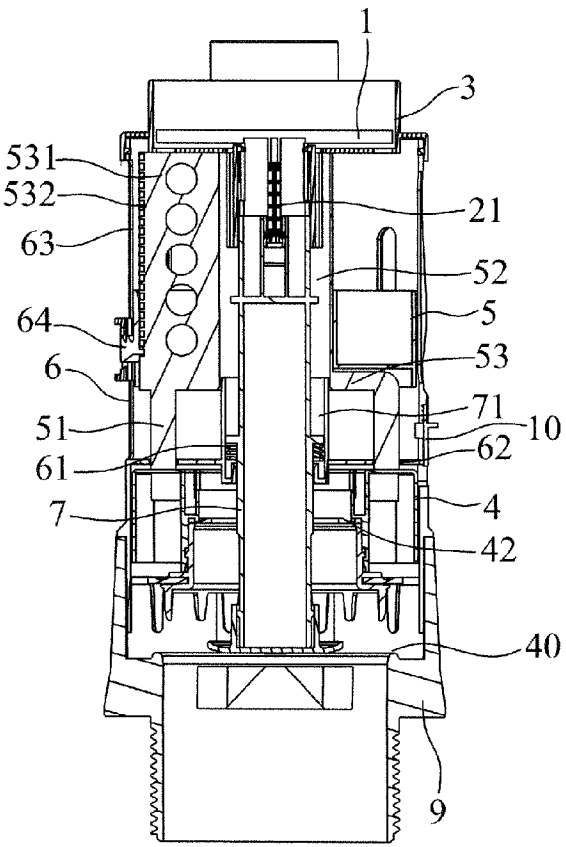
FIG. 4 is a cross-sectional view illustrating a full drain operation of the first embodiment of the present invention (front view of double-drain valve).
Figure 4:
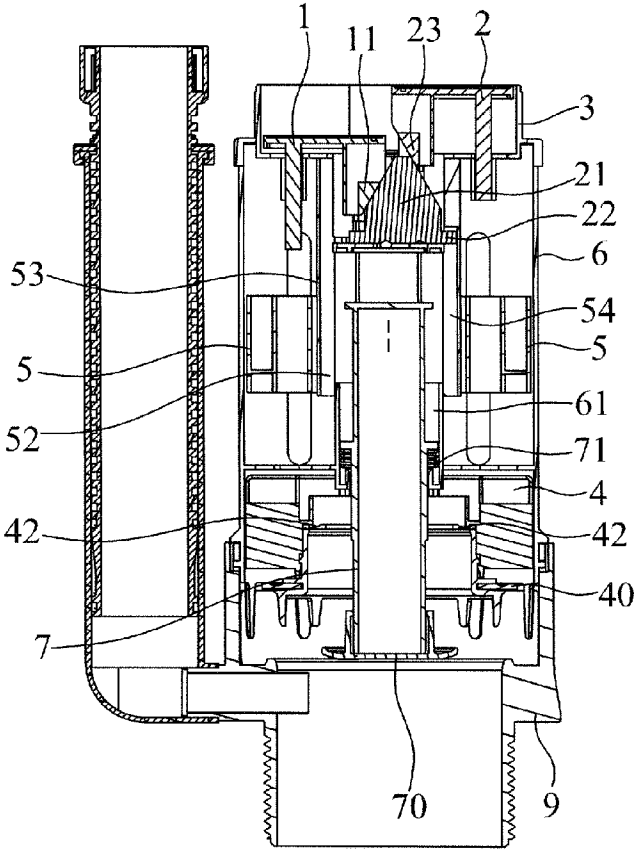
Figure 5:
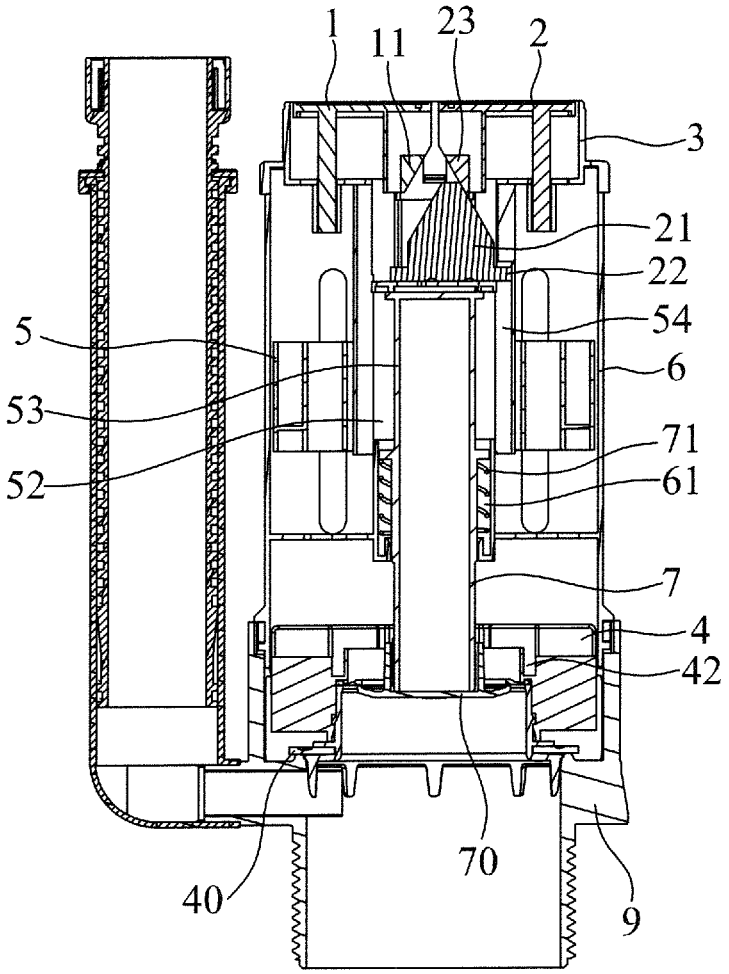
FIG. 5 is a cross-sectional view illustrating a condition of the first embodiment of the present invention after a full drain.

As shown in FIGS. 3-6, in the use the first embodiment of the present invention, full drain and partial drain are achieved as follows:

Initially in the condition shown in FIGS. 3 and 3-1, when the full-drain push button 1 is pressed down as indicated by FIGS. 4 and 4-1, the inner tube 7 is caused to move downward and the small water sealing frame 70 at the lower end of the inner tube 7 is separated from the small water sealing plate 42 mounted to the full-drain float 4, so that water is allowed to flow through the gap between the inner tube 7 and the inner tube insertion hole 41 of the full-drain float 4 toward the water discharging opening of the base 9, whereby a negative pressure is instantaneously formed above the full-drain float 4, causing the full-drain float 4 to automatically float upward to drive the large water sealing plate 40 to move upwards therewith so as to open the water discharging opening of the base 9 to achieve draining of water. After the full-drain push button 1 is pressed down, the position-limiting block 22 of the triangular block 21 is moved to insert into the position-limiting insertion slot 54 to constrain descent of the partial-drain weight float 5 and preventing the downward movement of the partial-drain adjustment press bar 51. When the water level inside the water tank is lowered to such a location where the buoyance of the full-drain float 4 is less than the own weight of the full-drain float 4, the full-drain float 4 is allowed to drive the large water sealing plate 40 to cover back the water discharging opening of the base 9. When the full-drain push button 1 is released, the inner tube 7 is acted upon by the return spring 71 to return to the original condition and the inner tube 7 drives the small water sealing frame 70 back to the original condition to re-engage the small water sealing plate 42 of the full-drain float 4 for closure, as shown in FIG. 5. This realizes a full drain operation.

Figures 1, 6:
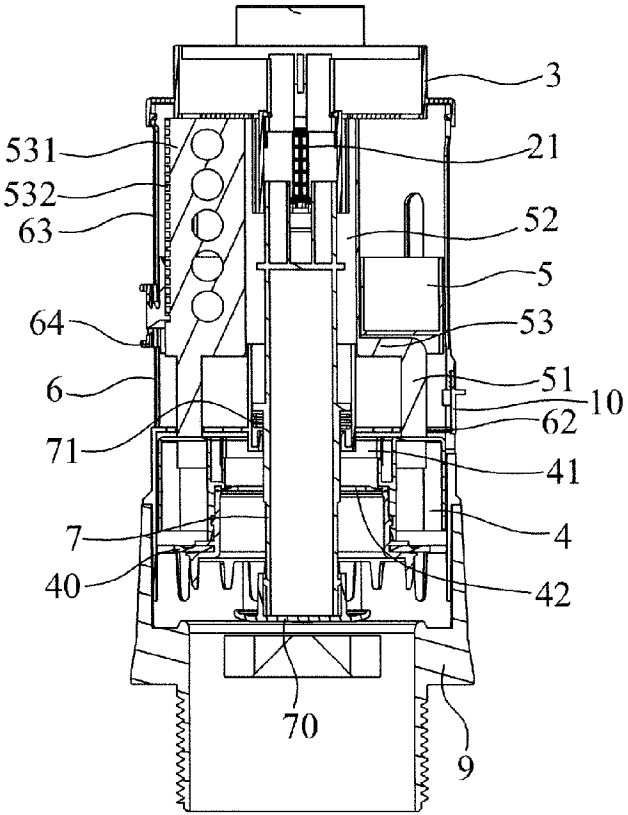
FIG. 6 is a cross-sectional view illustrating a partial drain operation of the first embodiment of the present invention (front view of double-drain valve).
Figure 6:
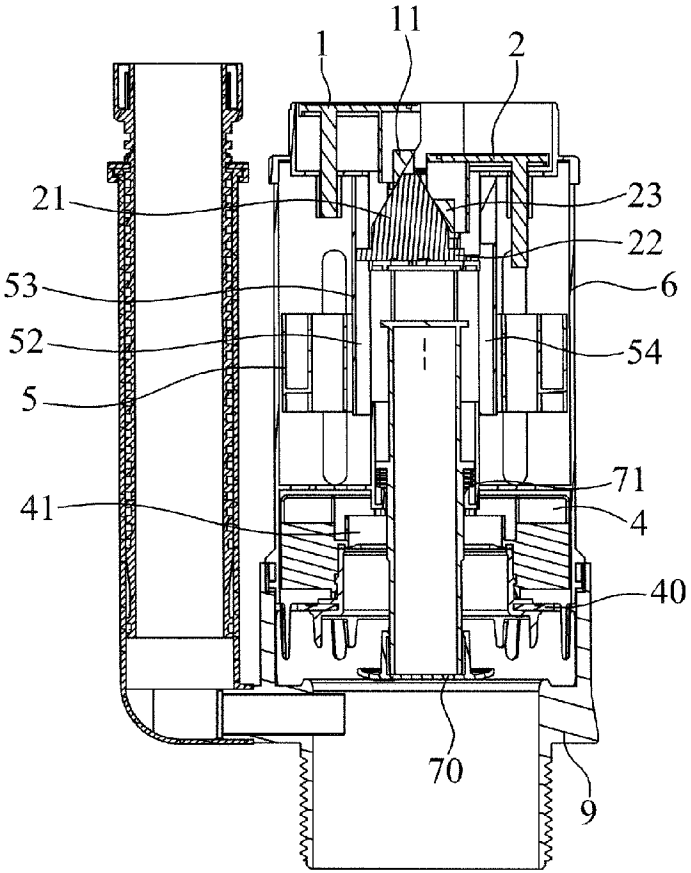

In the condition shown in FIG. 5, when the partial-drain push button 2 is pressed down as indicated by FIGS. 6 and 6-1, the inner tube 7 is caused to move downward and the small water sealing frame 70 arranged at the lower end of the inner tube 7 is separated from the small water sealing plate 42, so that water is allowed to flow through the gap between the inner tube 7 and the inner tube insertion hole 41 of the full-drain float 4 toward the water discharging opening of the base 9, whereby a negative pressure is instantaneously formed above the full-drain float 4, causing the full-drain float 4 to automatically float upward to drive the large water sealing plate 40 to move upwards therewith so as to open the water discharging opening of the base 9 to achieve draining of water. However, after the partial-drain push button 2 is pressed down, the position-limiting block 22 of the triangular block 21 is withdrawn out of the position-limiting insertion slot 54 and the partial-drain weight float 5 is not constrained from driving the partial-drain adjustment press bar 51 to move downward. When the water level inside the water tank drops to a predetermined water level line, water stored in the upper portion of the partial-drain weight float 5 is converted to a gravitational force that is greater than the combination of the buoyance of the full-drain float 4 and the buoyance generated by the lower portion of the partial-drain weight float 5 and the partial-drain adjustment press bar 51 drives the full-drain float 4 to cause the large water sealing plate 40 to early cover and close the water discharging opening of the base 9. When the partial-drain push button 2 is released, the inner tube 7 is acted upon by the return spring 71 to return to the original condition and the inner tube 7 drives the small water sealing frame 70 back to the original condition to re-engage the small water sealing plate 42 of the full-drain float 4 for closure, as shown in FIGS. 3 and 3-1. This realizes a partial drain operation.

In the first embodiment, a specific way of achieving up-down adjustment of the partial-drain weight float 5 on the partial-drain rack 53 is illustrated in FIGS. 7-12. The partial-drain weight float 5 comprises a resilient pawl 55 and hook strips 56 formed on a side wall thereof. The resilient pawl 55 has an upper end connected to the partial-drain weight float 5 and a lower end forming a positioning block 57 extending inward and a wedge-like inclined pull block 58 extending outwards. The partial-drain rack 53 comprises an up-down adjustment bar 531 formed on a side wall thereof. The up-down adjustment bar 531 comprises a row of adjustment teeth 532 formed thereon for engagement with the positioning block 57 of the partial-drain weight float 5. The main body 6 has a side surface in which an adjustment window 63 is formed. The partial-drain adjustment plate 64 is mounted in the adjustment window 63. The partial-drain adjustment plate 64 is in the form of a frame and two lateral sides of the partial-drain adjustment plate 64 form retention strips 65 engageable with the hook strips 56 to mount the partial-drain adjustment plate 64 to the partial-drain weight float 5. Top and bottom sides of the partial-drain adjustment plate 64 form operation blocks 66 extending outward for being used to move the partial-drain adjustment plate 64 in making adjustment. The top and bottom sides of the partial-drain adjustment plate 64 also form inclined push blocks 67 extending into the frame to mate the inclined pull block 58.

Figures 1, 7:
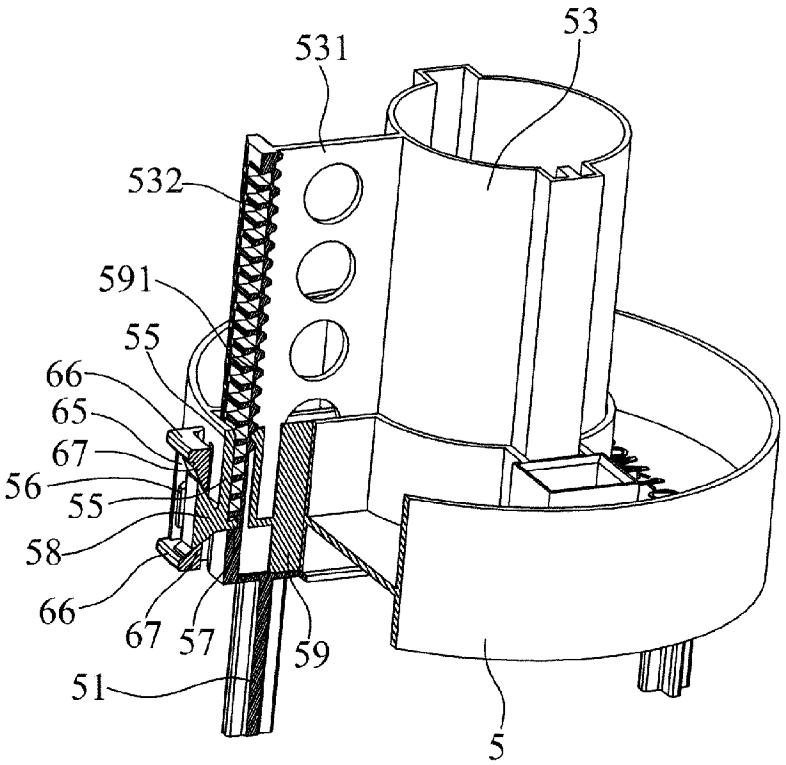
FIG. 7 is a perspective view showing the first embodiment of the present invention in an assembled form.
Figure 7:
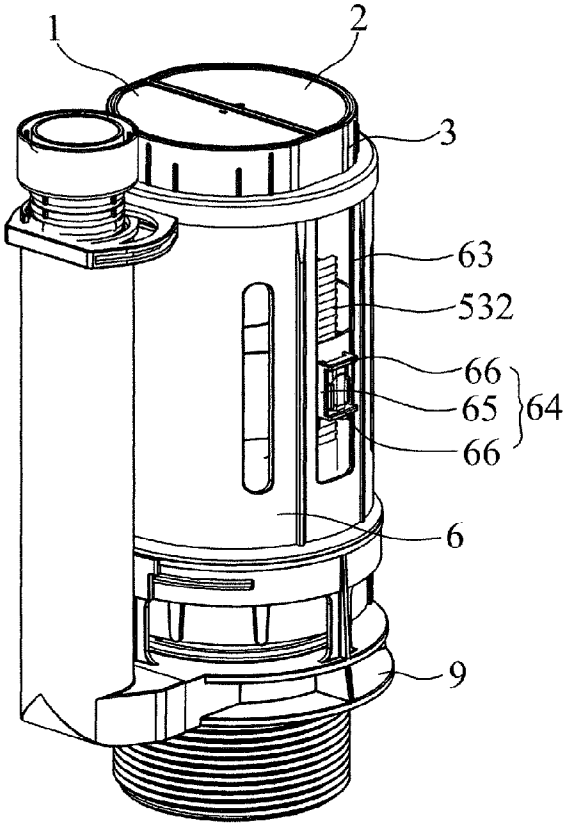
Figure 8:
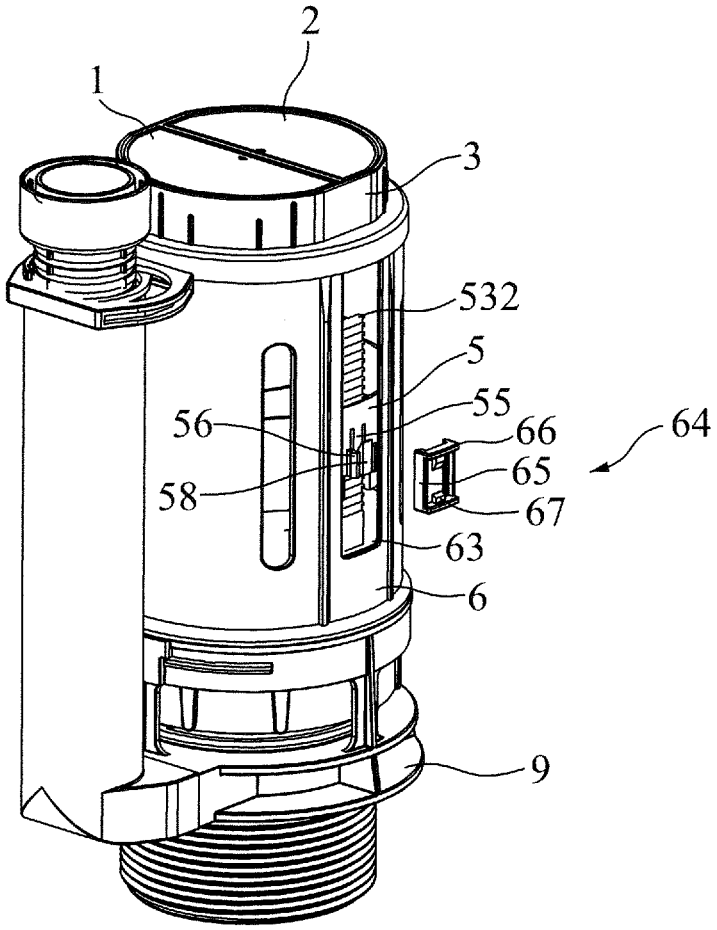
FIG. 8 is an exploded view of a partial-drain adjustment plate of the first embodiment of the present invention.
Figure 10:
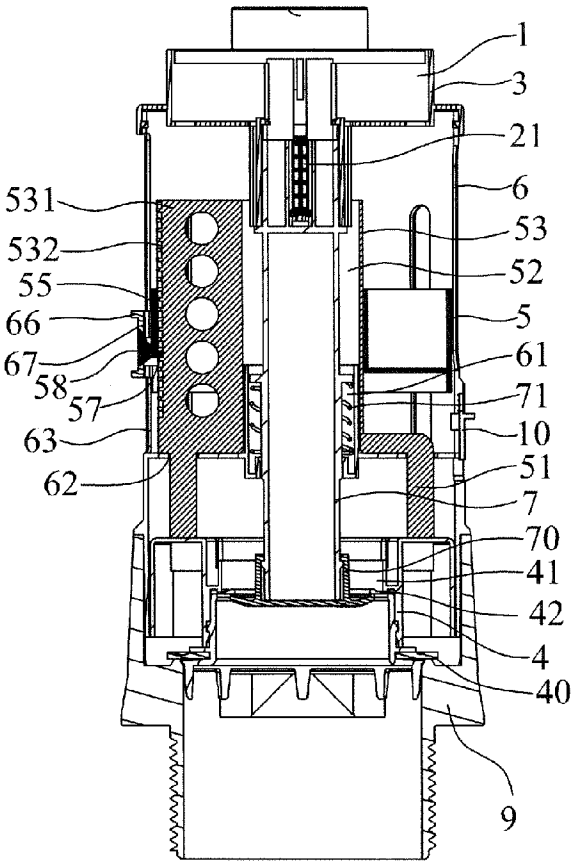
FIG. 10 is a cross-sectional view showing the partial-drain adjustment plate of the first embodiment of the present invention in an assembled form.

Further referring to FIG. 7-1, the present invention further comprises a positioning hook 59 formed in the partial-drain weight 5 and positioning teeth 591 formed on the opposite side of the adjustment teeth 532 of the partial-drain float rack 53. Engagement between the positioning hook 59 and the positioning teeth 591 allows for excellent positioning of the partial-drain weight 5 on the partial-drain float rack 53 and this, together with the partial-drain adjustment plate 64, ensures the partial-drain weight 5 is securely kept on the partial-drain float rack 53 during shipping and before installation.

Figure 12:
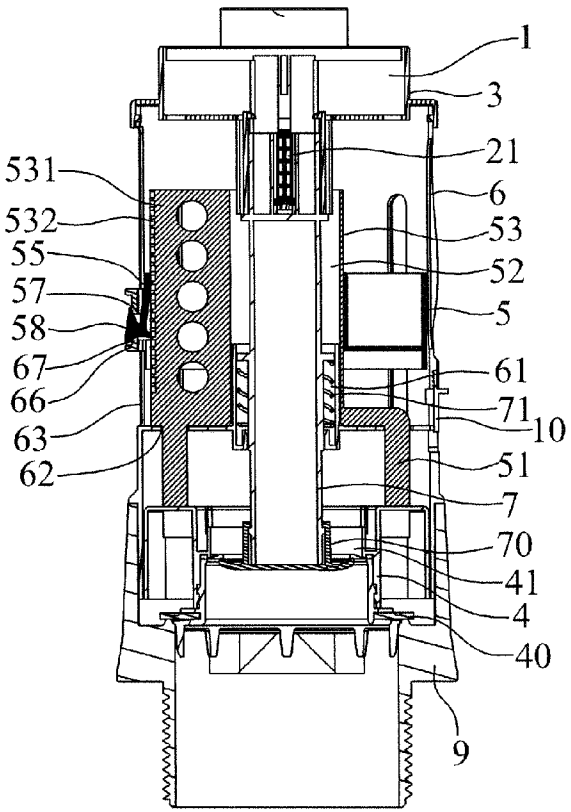
FIG. 12 is another cross-sectional view illustrating the adjustment operation of the partial-drain adjustment plate of the first embodiment of the present invention.
Figure 11:
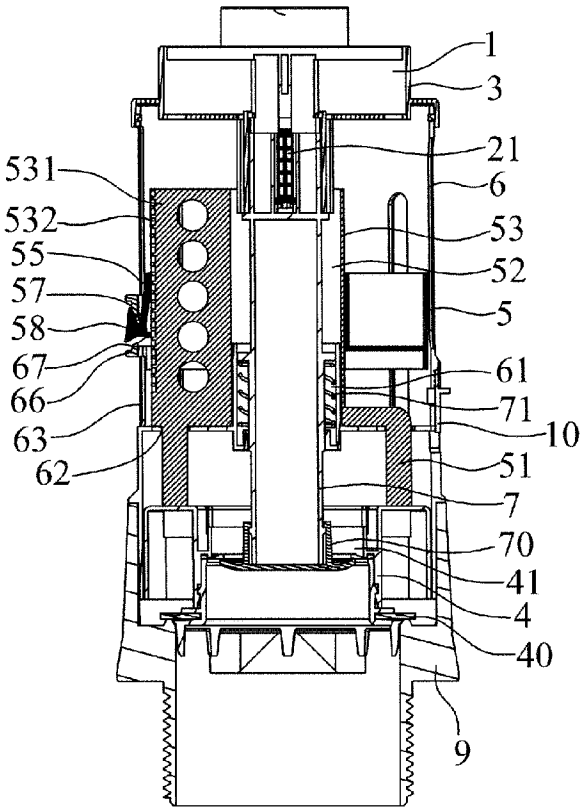
FIG. 11 is a cross-sectional view illustrating an adjustment operation of the partial-drain adjustment plate of the first embodiment of the present invention.
Figure 13:
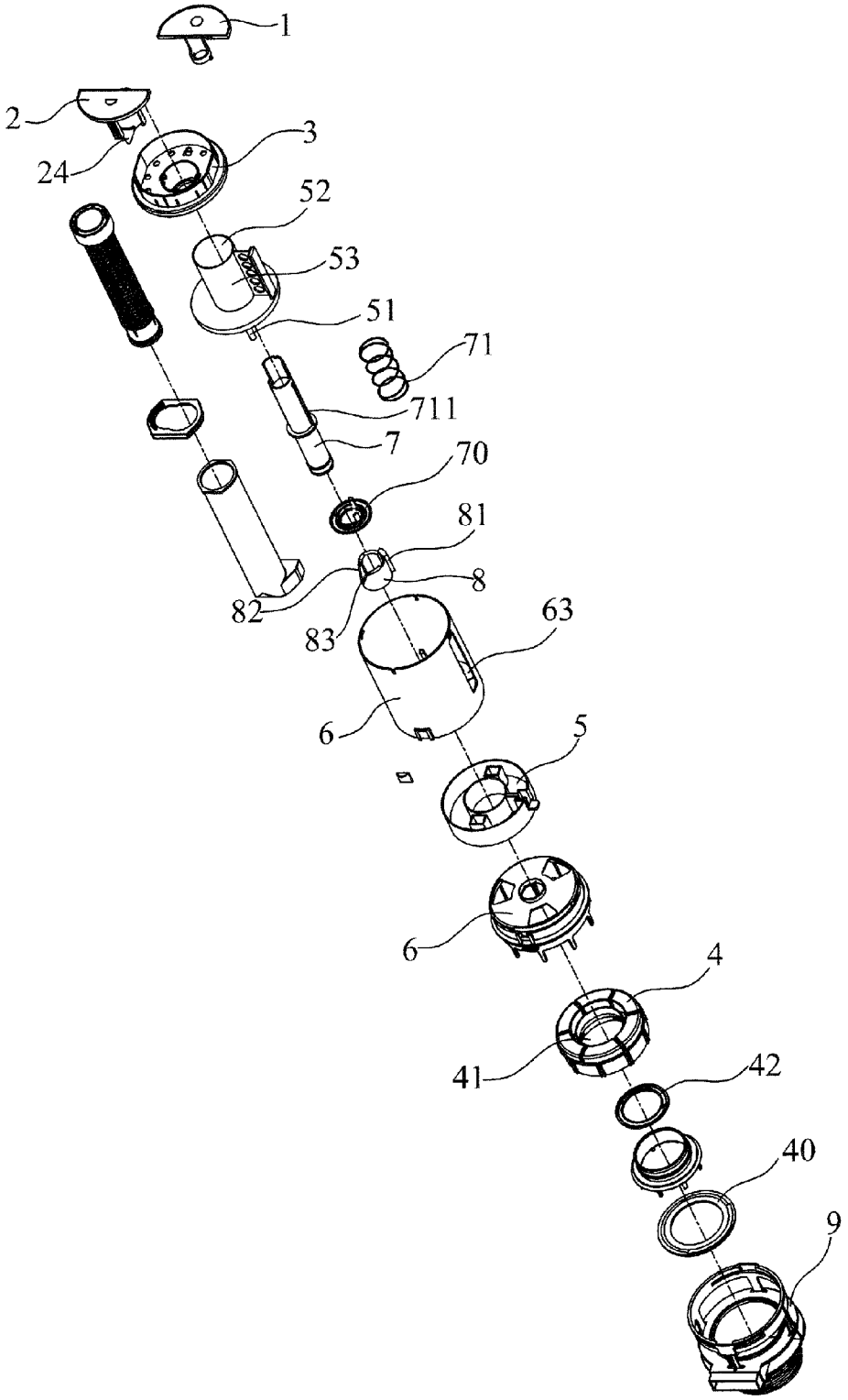
FIG. 13 is a top-side exploded view of a second embodiment of the present invention.
Figure 14:
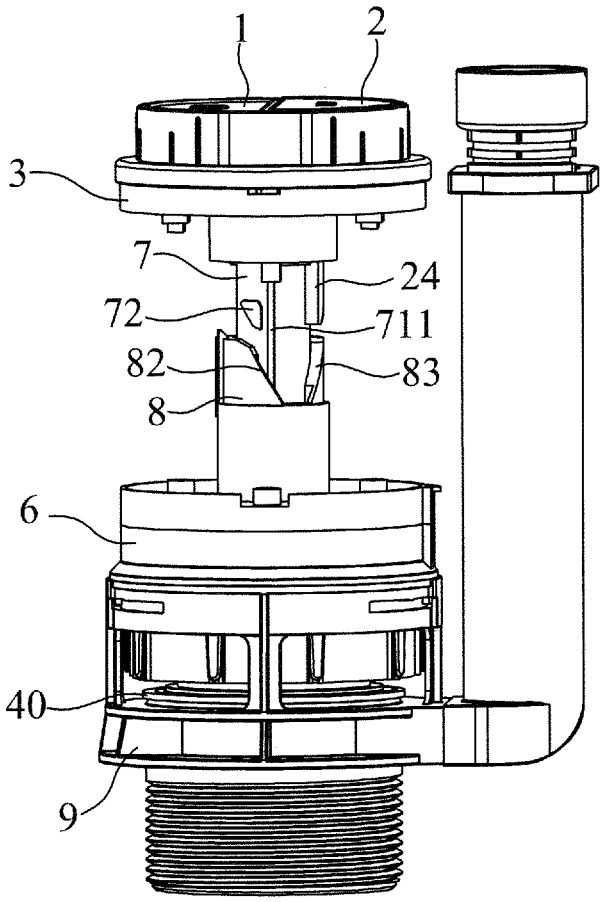
FIG. 14 is a schematic view showing the second embodiment of the present invention in an assembled form (with an upper portion of a main body and a partial-drain weight float omitted).
Figure 15:
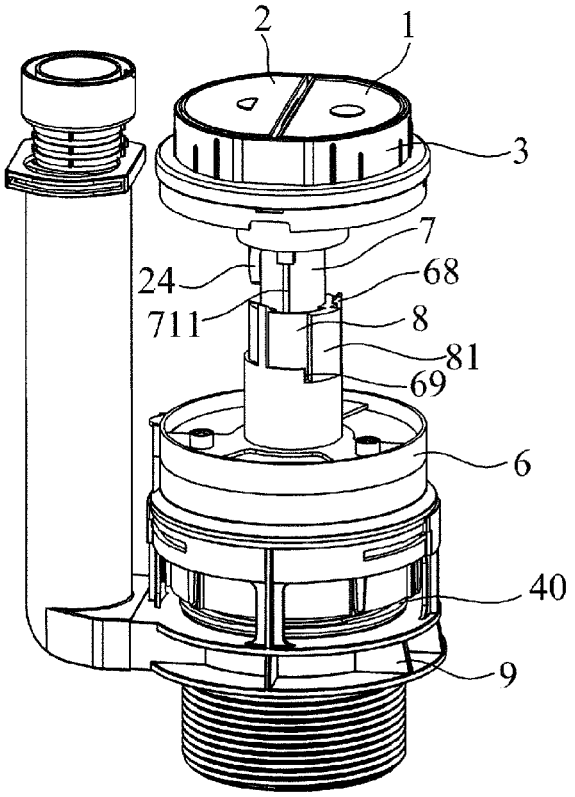
FIG. 15 is another schematic view showing the second embodiment of the present invention in the assembled form (with the upper portion of the main body and the partial-drain weight float omitted, being viewed from the rear side of FIG. 14).

In an initial condition as shown in FIG. 12, the partial-drain adjustment plate 64 is attached to the partial-drain weight float 5 by means of the engagement between the retention strips 65 and the hook strips 56. The partial-drain weight float 5 is attached to the partial-drain rack 53 by means of the engagement between the positioning block 57 formed on the lower end of the resilient pawl 55 and the adjustment teeth 532.

Figure 9:
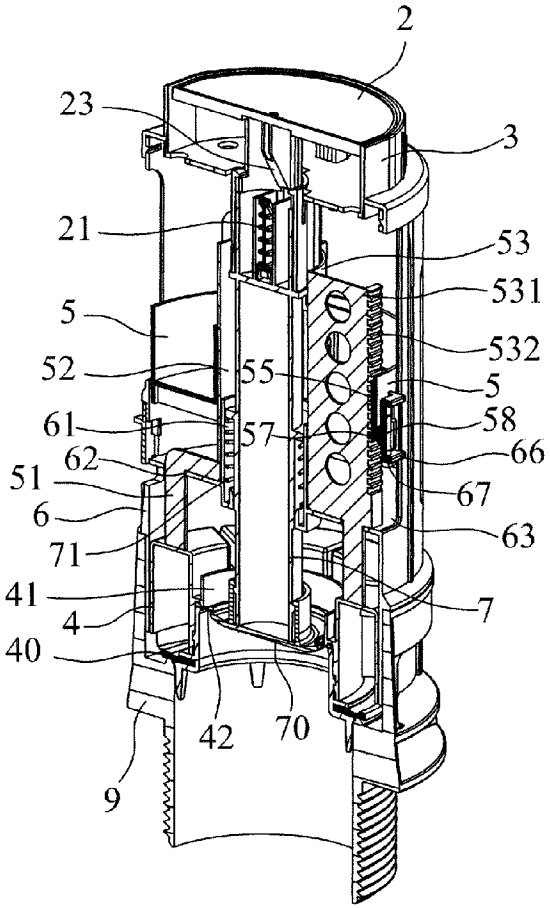
FIG. 9 is a perspective view, in a sectioned form, showing the partial-drain adjustment plate of the first embodiment of the present invention in an assembled form.

To actually carry out up-down adjustment, as shown in FIG. 9, the partial-drain adjustment plate 64 is pushed in a downward direction to have the upper inclined push block 67 mates an upper side of the inclined pull block 58. The resilient pawl 55 is thus forced outward to have the positioning block 57 disengage from the adjustment teeth 532. As such, the partial-drain adjustment plate 64 is allowed to freely move up and down to drive the partial-drain weight float 5 to move on the partial-drain rack 53 for up-down adjustment. After the adjustment has been made to reach a desired position, the partial-drain adjustment plate 64 is released and the resilient pawl 55 returns to have the positioning block 57 engage the corresponding one of the adjustment teeth 532, whereby the partial-drain weight float 5 is positioned on the partial-drain rack 53 and the up-down adjustment is completed. Similarly, in the situation illustrated in FIG. 12, the up-down adjustment can be achieved analogously.

It is certainly possible to adopt other ways of up-down adjustment of the partial-drain weight float 5 and details will not be given herein.

Further referring to FIGS. 13-16, a soft-touch double-drain valve according to a second embodiment of the present invention is shown, similarly comprising a full-drain push button 1, a partial-drain push button 2, a push button seat 3, a full-drain float 4, a partial-drain weight float 5, a main body 6, an inner tube 7, a first position-limiting mechanism, a second position-limiting mechanism, a small water sealing frame 70, a large water sealing plate 40, a small water sealing plate 42, and a base 9.

The second embodiment is different from the first embodiment primarily in that the structures of the first position-limiting mechanism and the second position-limiting mechanism are different from those of the previous description. The difference will be described hereinafter, while what are the same will not be repeatedly described.

Figure 16:
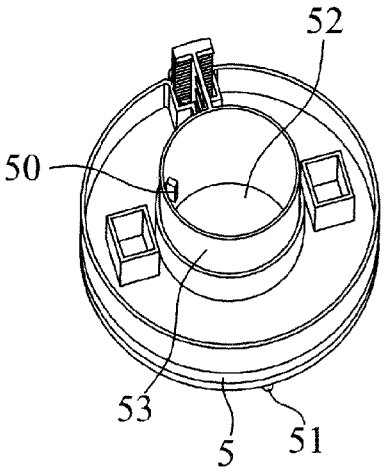
FIG. 16 is a perspective view of the partial-drain weight float of the second embodiment of the present invention.
Figure 17:
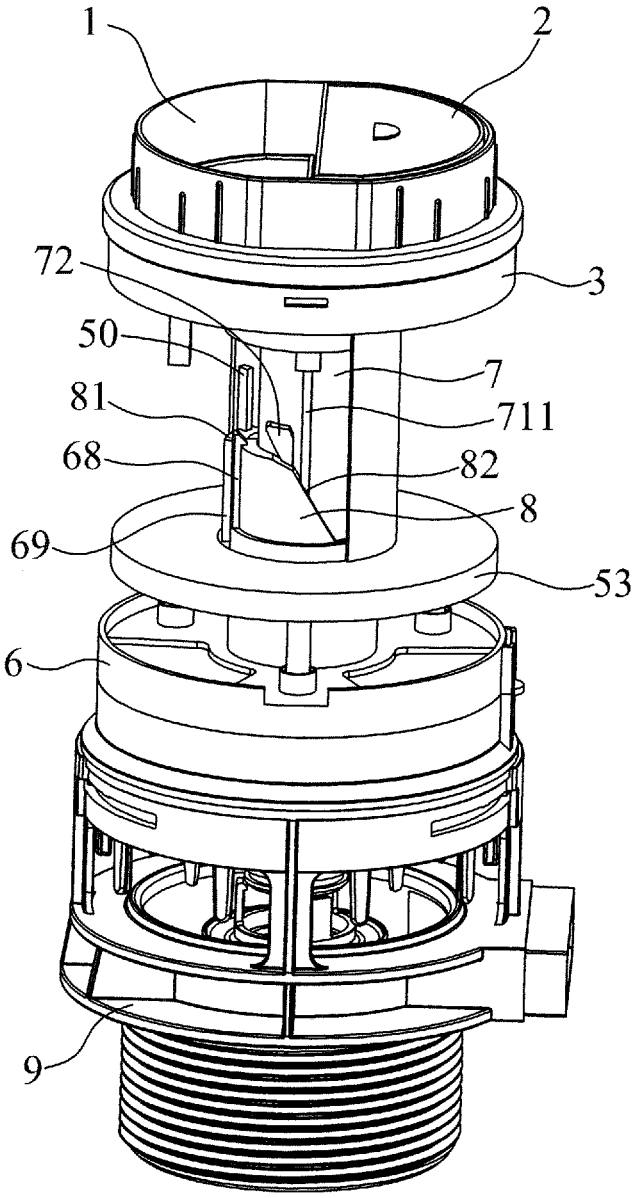
FIG. 17 is a schematic view illustrating a full-drain operation of the second embodiment of the present invention (with the upper portion of the main body and the partial-drain weight float omitted).
Figure 18:
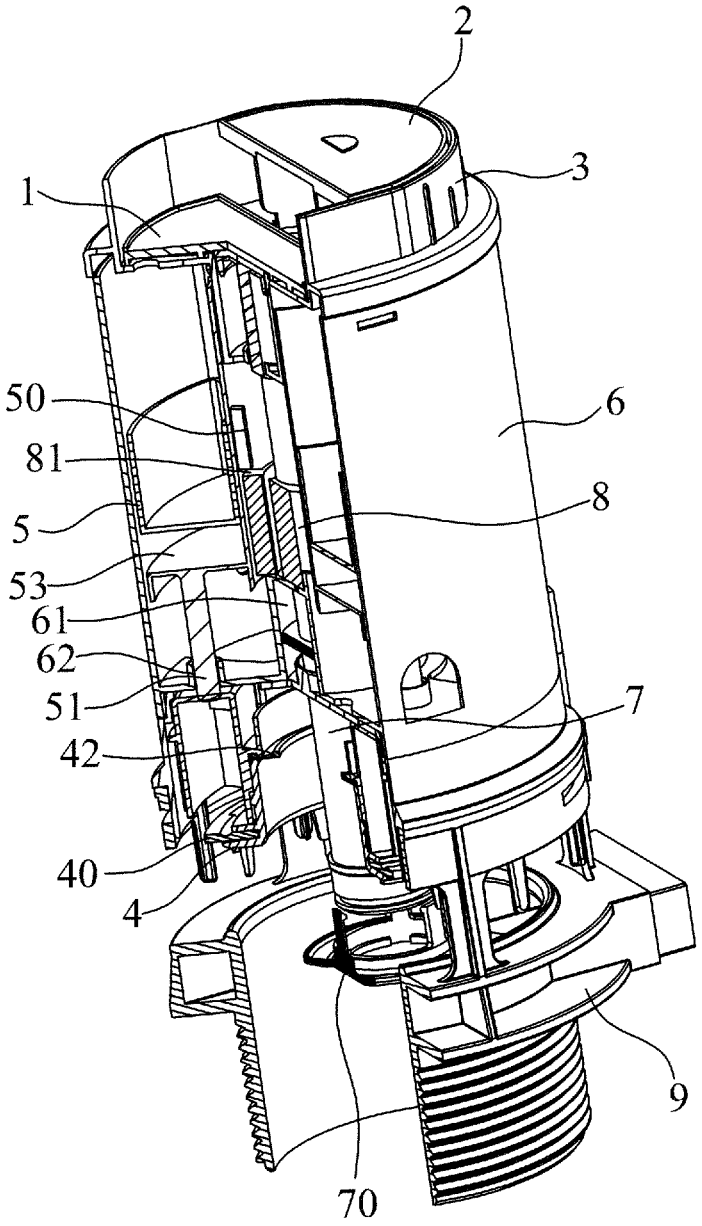
FIG. 18 is a cross-sectional view illustrating the full-drain operation of the second embodiment of the present invention.
Figure 19:
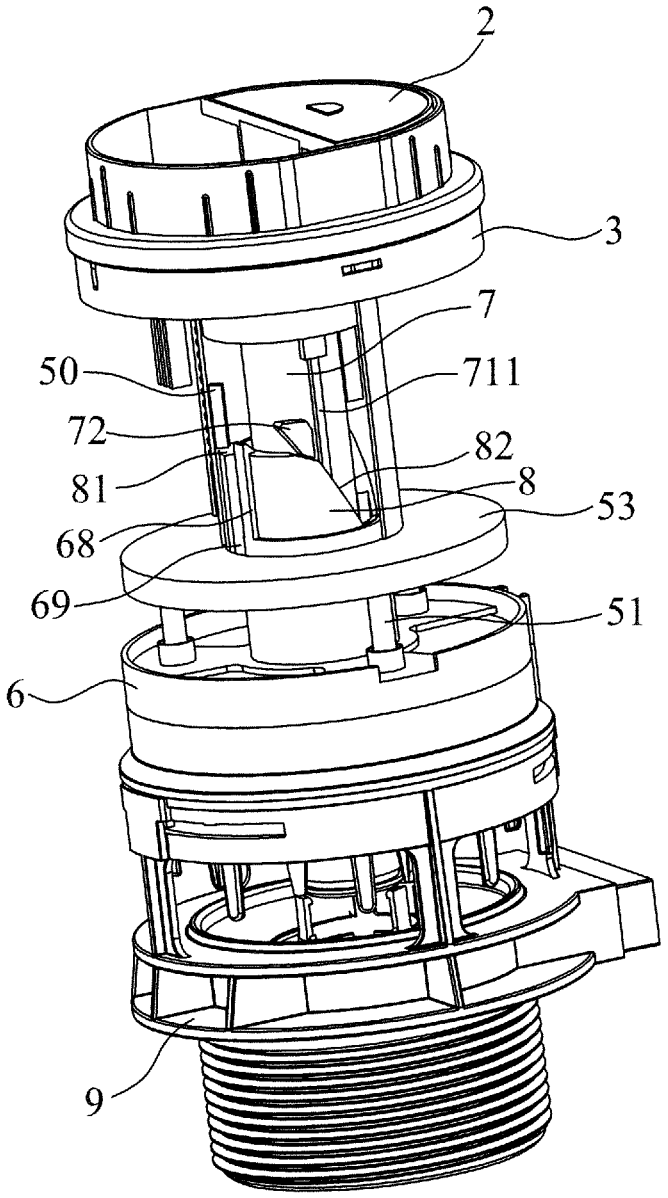
FIG. 19 is a schematic view illustrating a partial-drain operation of the second embodiment of the present invention (with the upper portion of the main body and the partial-drain weight float omitted).
Figure 20:
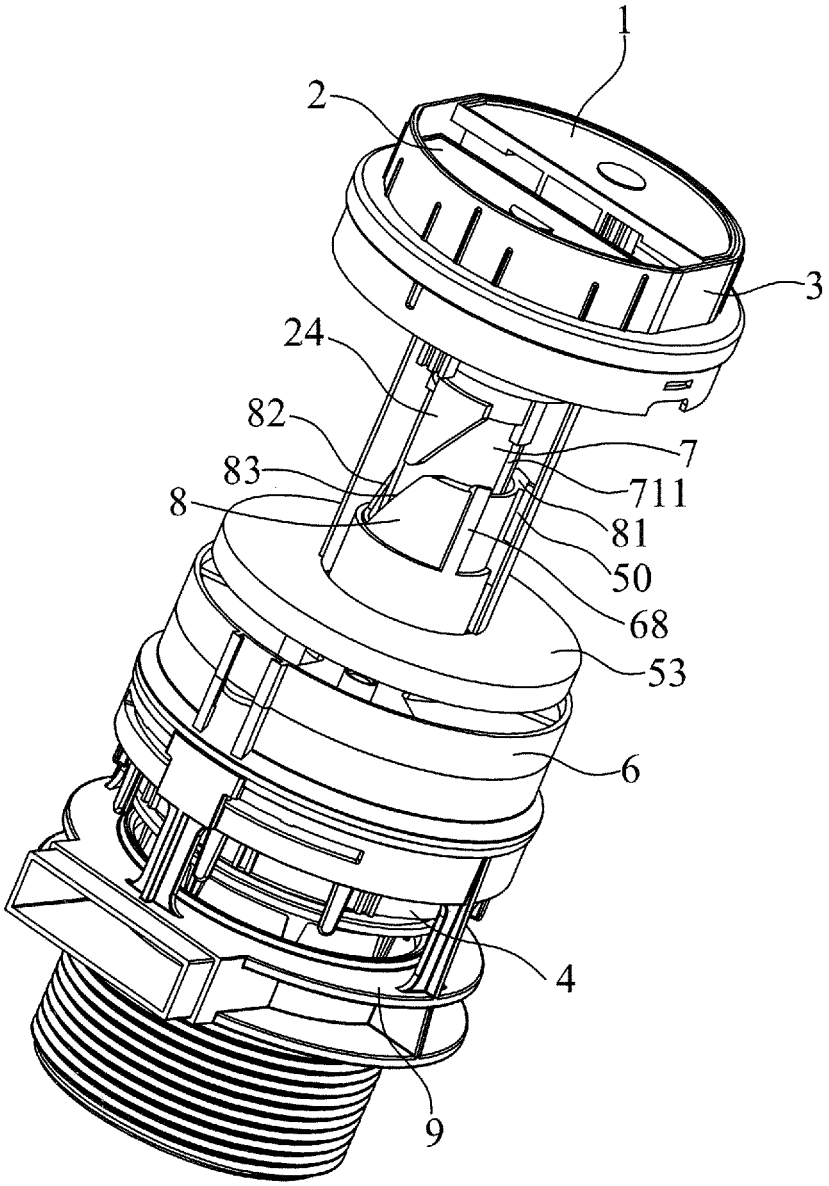
FIG. 20 is a schematic view illustrating the partial-drain operation of the second embodiment of the present invention (with the upper portion of the main body and the partial-drain weight float omitted, being viewed from the rear side of FIG. 19).
Figure 21:
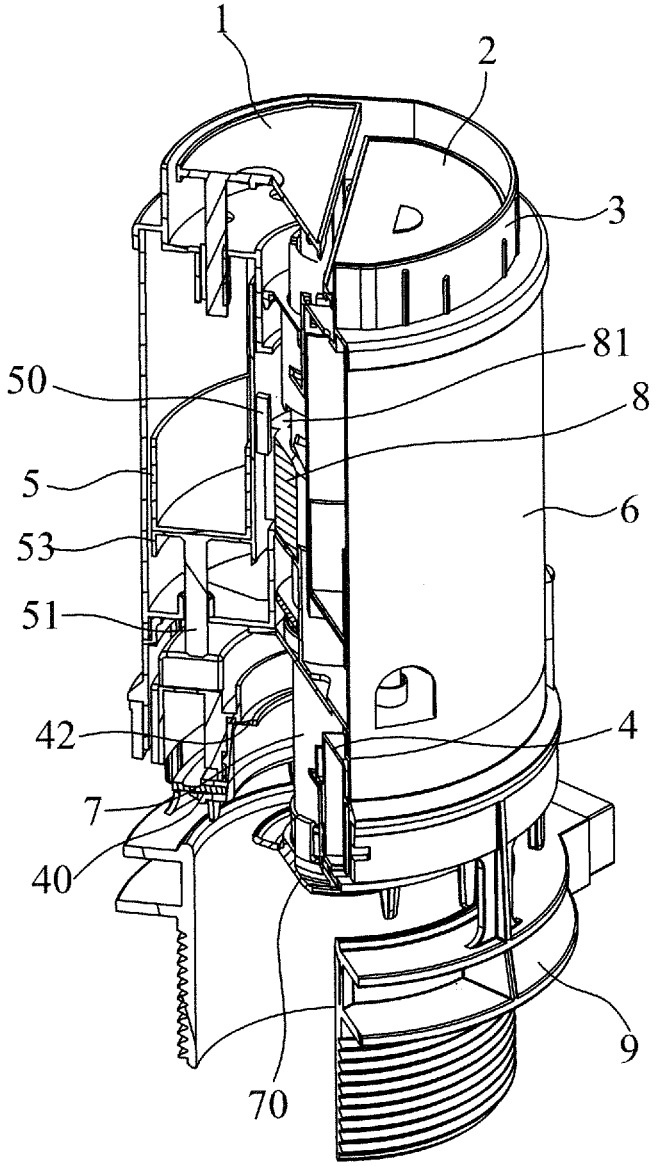
FIG. 21 is a cutaway view of the second preferred embodiment of the present invention.

In the second embodiment, the inner tube through hole 61 of the main body 6 also comprises a rotation ring 8 mounted therein. Specifically, the inner tube through hole 61 has a circumference on which axial hooks 68 are formed. The axial hooks 68 functions to position the rotation ring 8 in an axial direction. A rotation angle limiting structure is further provided between the main body 6 and the rotation ring 8. The rotation angle limiting structure can be specifically structured as follows. A slot 69 is formed in a top edge of the inner tube through hole 61 of the main body 6 and a raised strip 81 is formed on an outer wall of the rotation ring 8. Through an arrangement of allowing the raised strip 81 to slide and thus rotate in the slot 69, limiting the rotation angle of the rotation ring 8 with respect to the main body 6 can be achieved. The rotation ring 8 is fit over the inner tube 7. The rotation ring 8 comprises a locking guide surface 82 and an unlocking guide surface 83. The rotation ring further comprises a first descent-limiting block. The first descent-limiting block can be separately formed or the raised strip 81 and the first descent-limiting block of the rotation ring 8 are integrated together. In other words, a top end of the raised strip 81 may serve as the first descent-limiting block for the purpose of simplification of structure. A second descent-limiting block 50 is formed on the partial-drain weight float 5 or the partial-drain rack 53 and in the second embodiment, the second descent-limiting block 50 is formed on an inside wall of the partial-drain rack 53, as shown in FIG. 16. The inner tube 7 comprises a locking pressing block 72 formed on an outside wall thereof to correspond to the locking guide surface 82. The above-described structures, when combined, constitute the first position-limiting mechanism. To ensure accurate combination of the locking pressing block 72 and the locking guide surface 82. The second embodiment also comprises axially extending recessed slots (which are not visible due to the viewing angle of the drawings) and axially extending ribs 711 respectively formed in the an inside wall of the inner tube through hole 61 and on the outside wall of the inner tube 7. The ribs 711 are engageable with the recessed slots to prevent rotation of the inner tube 7 in the through hole 61.

In the second embodiment, the partial-drain push button 2 comprises an unlocking pressing block 24 formed on a lower end thereof to correspond to the unlocking guide surface 83. The unlocking pressing block 24 constitutes the second position-limiting mechanism.

The second embodiment makes use of the cooperative combination of the first position-limiting mechanism and the second position-limiting mechanism to prevent a downward movement of the partial-drain adjustment press bar 51 during a full drain operation. A specific operation is illustrated in FIGS. 17-21. When the full-drain push button 1 is pressed down for full drain, the full-drain push button 1 depresses the inner tube 7 to move the locking pressing block 72 into engagement with the locking guide surface 82 so as to cause the rotation ring 8 to rotate to such a position where the first descent-limiting block (the to end of the raised strip 81) is in alignment with the second descent-limiting block 50, thereby constraining descent of he partial-drain weight float 5 and preventing downward movement of the partial-drain adjustment press bar 51. When the water level inside the water tank is lowered to such a location where the buoyance of the full-drain float 4 is less than the own weight of the full-drain float 4, the full-drain float 4 is allowed to drive the large water sealing plate 40 to cover back the water discharging opening of the base 9, thereby realizing full drain. When the partial-drain push button 2 is pressed down for partial drain, the partial-drain push button 2 moves the unlocking pressing block 24 into engagement with the unlocking guide surface 83 so as to cause the rotation ring 8 to rotate back to a position where the first descent-limiting block (the to end of the raised strip 81) is shifted away from the second descent-limiting block 50, releasing the constraint against downward movement of the partial-drain adjustment press bar 51. When the water level inside the water tank drops to a predetermined water level line, water stored in the upper portion of the partial-drain weight float 5 is converted to a gravitational force that is greater than the combination of the buoyance of the full-drain float 4 and the buoyance generated by the lower portion of the partial-drain weight float 5 and the partial-drain adjustment press bar 51 moves with the partial-drain adjustment press bar 51 to drive the full-drain float 4 to cause the large water sealing plate 40 to early cover and close the water discharging opening of the base 9, thereby realizing partial drain.

It s noted that the present invention may further comprises a full-drain adjustment window in the main body 6 for mounting the full-drain adjustment plate 10, whereby adjustment of the amount of water entering the negative pressure chamber can be made with the full-drain adjustment plate 10 to achieve adjustment of the amount of water drained in an full drain operation.

The key point of the present invention is to arrange a partial-drain push button 2, a partial-drain weight float 5, and a first position-limiting mechanism and a second position-limiting mechanism on an inner tube included double-drain valve. In use, the first position-limiting mechanism and the second position-limiting mechanism collectively constrain the operation of the partial-drain weight float 5 to achieve full drain and, after the constraint is released, the partial-drain weight float 5 helps realize partial drain. The first position-limiting mechanism and the second position-limiting mechanism are not limited to the first and second embodiments and can be any structures that constrain the operation of the partial-drain weight float 5 in full drain to ensure independent operation of the full-drain float 4. Further, the up-down adjustment of the partial-drain weight float 5 on the partial-drain rack 53 is for adjusting the amount of water for half drain and the arrangement thereof is not limited to what shown in the first embodiment and can be any arrangement that can achieve up-down adjustment of the partial-drain weight float 5.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A soft-touch double-drain valve, characterized by comprising a full-drain push button, a partial-drain push button, a push button seat, a full-drain float, a partial-drain weight float, a main body, an inner tube, a first position-limiting mechanism, a second position-limiting mechanism, a small water sealing frame, a large water sealing plate, a small water sealing plate, and a base; wherein the large water sealing plate is set on a water discharging opening of the base and the large water sealing plate is mounted at a bottom of the full-drain float; the full-drain float comprises an inner tube insertion hole formed therein and the small water sealing plate is mounted to the insertion hole; the main body is mounted on the base and the main body comprises an inner tube through hole and adjustment holes formed in a bottom thereof; the partial-drain weight float is mounted in the main body, the partial-drain weight float comprising a partial-drain adjustment press bar formed on a bottom thereof, the partial-drain adjustment press bar extending through an adjustment hole formed in the bottom of the main body and located above the full-drain float, the partial-drain weight float comprising an inner tube penetration hole formed therein; the first position-limiting mechanism is mounted in the main body; the push button seat is mounted atop the main body, the full-drain push button and the partial-drain push button being mounted to the push button seat, the second position-limiting mechanism being mounted to the full-drain push button or the partial-drain push button, the first position-limiting mechanism and the second position-limiting mechanism being operable with each other to prevent a downward movement of the partial-drain adjustment press bar in a full drain operation; and the inner tube extends through the inner tube penetration hole, the inner tube through hole, and the inner tube insertion hole, the inner tube being provided with a return spring, the inner tube having a lower end to which the small water sealing frame that is operable in combination with the small water sealing plate is mounted, the inner tube having an upper end that is operable in combination with the full-drain push button and the partial-drain push button to control the downward movement of the inner tube; wherein the partial-drain weight float further comprises a partial-drain rack, the partial-drain weight float being mounted to the partial-drain rack in an up-down adjustable manner, the partial-drain rack is provided, at the bottom thereof, with the partial-drain adjustment press bar, the partial-drain weight float having a lower portion forming a float and an upper portion forming a water storage cup, a position-limiting insertion slot is formed in the partial-drain weight float or the partial-drain rack, the position-limiting insertion slot constituting the first position-limiting mechanism; a triangular block is mounted under the full-drain push button and the partial-drain push button, the full-drain push button and the partial-drain push button having bottoms that respectively form slope surfaces respectively corresponding to two slope side edges of the triangular block, the triangular block having a bottom side that forms a position-limiting block engageable with the position-limiting insertion slot, the triangular block and slope surfaces of the full-drain push button and the partial-drain push button collectively constituting the second position-limiting mechanism; and when the triangular block is pressed downward with the full-drain push button, the position-limiting block of the triangular block is inserted into the position-limiting insertion slot thereby constraining descent of the partial-drain weight float and preventing a downward movement of the partial-drain adjustment press bar so as to achieve full drain and when the triangular block is pressed downward with the partial-drain push button, the position-limiting block of the triangular block is withdrawn out of the position-limiting insertion slot, releasing the constraint against the downward movement of the partial-drain adjustment press bar so as to allow for the achievement of partial drain.

2. The soft-touch double-drain valve according to claim 1, characterized in that: the partial-drain weight float comprises a resilient pawl and hook strips formed on a side wall thereof, the resilient pawl having an upper end connected to the partial-drain weight float and a lower end forming a positioning block extending inward and a wedge-like inclined pull block extending outwards; the partial-drain rack comprises an up-down adjustment bar formed on a side wall thereof, the up-down adjustment bar comprising a row of adjustment teeth formed thereon for engagement with the positioning block of the partial-drain weight float; the main body has a side surface in which an adjustment window is formed; the partial-drain adjustment plate is mounted in the adjustment window and the partial-drain adjustment plate is in the form of a frame having two lateral sides forming retention strips engageable with the hook strips to mount the partial-drain adjustment plate to the partial-drain weight float and top and bottom sides forming operation blocks extending outward, the top and bottom sides further forming inclined push blocks extending into the frame to mate the inclined pull block.

3. The soft-touch double-drain valve according to claim 2, characterized in that: a positioning hook is formed in the partial-drain weight float and positioning teeth are formed on the opposite side of the adjustment teeth of the partial-drain float rack, whereby the partial-drain weight float is positioned on the partial-drain float rack by means of engagement between the positioning hook and the positioning teeth.

4. The soft-touch double-drain valve according to claim 1, characterized in that: the partial-drain weight float comprises a weigh portion that comprises a water storage cup that is formed separately, the partial-drain weight float comprising a float portion that is formed on the partial-drain rack.

* * * * *